United States Patent [19]

Leff

[11] 4,165,890

[45] Aug. 28, 1979

[54] COMMUNICATION AID

[76] Inventor: Ruth B. Leff, 6589 N. Crestwood Dr., Glendale, Wis. 53209

[21] Appl. No.: 869,168

[22] Filed: Jan. 13, 1978

[51] Int. Cl.[2] ..... B42D 15/00; B42F 5/00

[52] U.S. Cl. ..... 283/7; 35/9 R; 40/10 R; 283/46

[58] Field of Search ..... 283/7, 18, 20, 21, 46, 283/56; 35/9 R, 35 R, 35 J; 40/10 R

[56] References Cited

U.S. PATENT DOCUMENTS

| | | | |
|---|---|---|---|
| 335,837 | 2/1886 | Peckham | 35/9 R X |
| 2,511,651 | 6/1950 | Schlitz | 40/10 R X |
| 3,827,726 | 8/1974 | McVoy et al. | 283/7 |
| 3,871,115 | 3/1975 | Glass et al. | 283/46 X |

*Primary Examiner*—Travis S. McGehee

*Attorney, Agent, or Firm*—Andrus, Sceales, Starke & Sawall

[57] ABSTRACT

A communication aid comprising an assembly of illustrations individually mounted on a ring to provide a basic means of communication for individuals who have difficulty expressing their needs, or who cannot be understood by others. Each illustration or picture represents a necessity of living and is contained within the pocket of a transparent plastic envelope. Each envelope is mounted for free sliding movement on a ring. By sliding the envelopes along the ring, the individual can point to the illustration indicating his need.

2 Claims, 4 Drawing Figures

COMMUNICATION AID

BACKGROUND OF THE INVENTION

People with oral communication problems, such as those who have a limited English vocabulary or those having physical and mental developmental disabilities, have difficulty in communicating their basic needs to others. In the past, booklets have been developed having a series of illustrations or pictures on each page representing the basic needs of living, such as, for example, bed, blanket, tissue, razor, brush, bathroom, and the like. While booklets of this type have been an effective tool in therapy to improve auditory and visual comprehension and to expand expressive language, the booklets have not been universally satisfactory for all individuals. In some cases, the materials have been too large and bulky for persons with motor control defects to handle. In other cases, a person with an infirmity, such as aphasia, is unable to focus attention on any one picture of a group of several, and thus the booklet containing a number of pictures on each page is unsatisfactory for this physical deficiency. Similarly, individuals with multiple sclerosis lack motor control and cannot turn thin paper pages and are unable to designate any one picture or illustration out of a group appearing on one page.

SUMMARY OF THE INVENTION

The present invention is directed to a communication aid comprising an assembly of illustrations or pictures, individually mounted on a ring to provide a basic means of communication for persons who have difficulty expressing their needs or cannot be understood by others. In accordance with the invention, each illustration or picture representing a necessity of living is contained within the pocket of a transparent plastic envelope and each envelope is provided with a hole enabling the envelope to be mounted for free sliding movement on a ring.

The ring is composed of a pair of generally simicircular hinged sections and the free ends of the ring sections are locked together so that the outer surface of the ring is substantially free of obstructions. Thus, the envelopes can be readily slid along the ring and the patient or individual can point to the illustration indicating his need.

As each illustration is in an individual envelope the individual, even those with limited motor control or other physical deficiencies, can designate the desired illustration representing his need.

The ring is rigid with a smooth outer surface so that the envelopes can readily slide along the ring. For the individual with limited fine motor control, the envelopes slide easily, whether pulled downward or pushed upward using the palm of the hand. If the patient is unable to slide the envelopes along the ring and designate the desired illustration, a second person can manipulate the envelopes and the patient can designate the desired illustration by a signal, such as a nod, finger movement, blink, etc.

The envelopes are preferably made of a plastic material, such as vinyl, and are flexible and easy to clean. The ring, through use of retaining cord, can be attached to an available object, such as a bed or wheelchair, or to the belt or wrist of the individual.

The communication aid of the invention can be used by persons with speech difficulties, hearing impairments, voice disorders, visual impairments, learning or language problems, mentally retarded, cerebal palsy, stroke, after effects of surgery, muscular dystrophy, myasthenia gravis, multiple sclerosis, Parkinsonism, emphysema, laryngectomees, and the like. The aid has use in homes, schools, hospitals, rehabilitation centers, nursing homes and other institutions.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
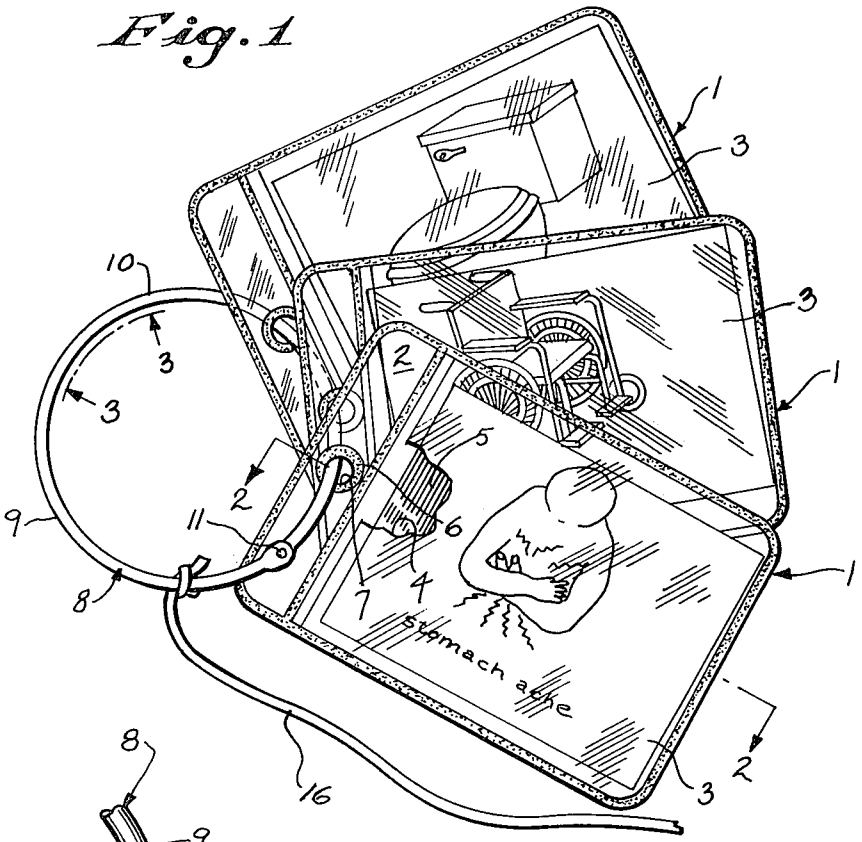
FIG. 1 is a perspective view of showing the communication aid of the invention.

The communication aid of the invention includes a series of transparent plastic envelopes 1, preferably made of flexible plastic material, each of which is composed of a backing sheet 2 and a front sheet 3, which is joined to the backing sheet 2 by heat sealing along three edges. The fourth edge of the front sheet 3 is not sealed to the backing and provides access to a pocket 4 located between the backing sheet 2 and the front sheet 3.

An illustration or picture 5 is adapted to be contained within the pocket 4 of each envelope 1 and each illustration 5 represents a necessity of living, as will be more fully described hereinafter.

A tab 6 is heat sealed to the projecting end of the backing sheet 2 of each envelope and aligned openings 7 are provided in the tab and backing sheet 2 which receives a ring 8. Ring 8 is composed of a pair of sections 9 and 10 hinged together by pin 11. Each ring section 9 and 10 is generally semi-circular and the free ends of the ring sections are joined together by cooperating or mating locking elements 12 and 13. By flexing the sections 9 and 10 in an axial or lateral direction, the locking elements 12 and 13 can be disengaged and the sections can be pivoted to an open position for insertion or removal of the envelopes 1.

Figure 2:
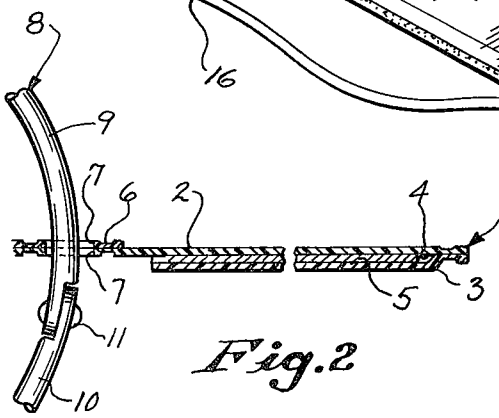
FIG. 2 is a section taken along line 2—2 of FIG. 1.
Figure 3:
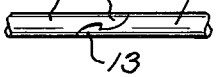
FIG. 3 is a section taken along line 3—3 of FIG. 1.

The ring 8 has, as best illustrated in FIGS. 1, 2, and 3, minimum external obstructions on its outer surface so that the envelopes can freely slide along the ring.

Figure 4:
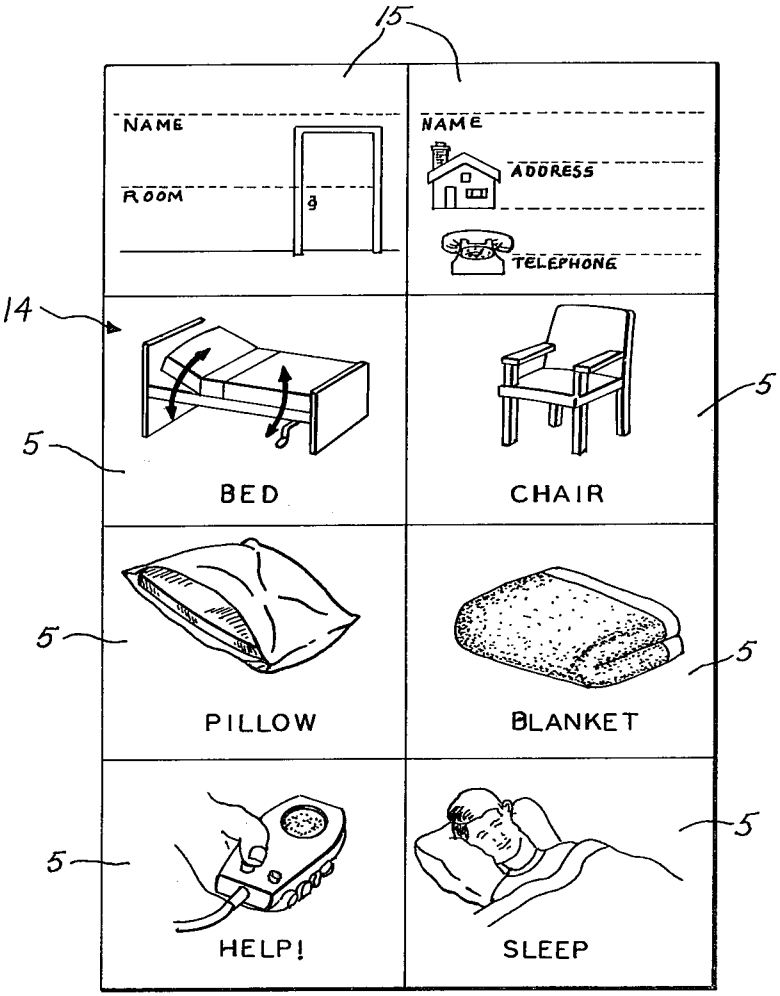
FIG. 4 is a plan view of a sheet containing a group of illustrations.

The illustrations 5 which are contained within the envelopes are cut from a sheet 14, as shown in FIG. 4. The illustrations 5 represent a series of necessities of living which, as shown in the drawings, comprise, "bed", "pillow", "help", "chair", "blanket" and "sleep". In addition, the top of the sheet 14 includes two sections 15 and these sections can also be cut from the sheet and placed in an envelope to provide basic information regarding the patient or individual.

In practice, there may be a large number of pictures or illustrations 5 on a number of different sheets 14. The particular illustrations to be used depend upon the needs of the patient or individual.

A cord 16 can be attached to the ring 8 so that the ring and envelopes may be attached in a convenient location to the patient. In some cases the cord may be attached to the bed, wheelchair or table, or in other cases the cord may be attached to the belt, or wrist of the patient.

As each illustration is in an individual envelope, the patient, even those with limited fine motor control, can designate the particular illustration or need requirement.

The ring has a relatively smooth outer surface enabling the envelopes to be readily moved along the ring. As the pockets are open-ended, various illustrations can be inserted or removed depending on the needs of the patient.

While the above description has shown the illustrations 5 as representations of necessities of living, it is contemplated that the illustrations can be words, letters of the alphabet, phrases, photographs, colors, or other indicia, depending on the particular use of the communication aid. For example if used as an educational tool for children, the illustrations 5 could be the letters of the alphabet, pictures of animals, colors, etc.

It is also contemplated that the illustrations 5, instead of being cut from a sheet 14, can be printed on individual cards and packaged in a box or container. If relatively stiff cards are used, the cards can then be mounted directly on the ring or connector, rather than using the envelopes 1, as described above.

Various modes of carrying out the invention are contemplated as being within the scope of the following claims, particularly pointing out and distinctly claiming the subject matter which is regarded as the invention.

I claim:

1. A communication aid, comprising a plurality of individual envelopes each having a transparent open-ended pocket, each envelope having a hole disposed adjacent the open end of the pocket, a card having an illustration representing a necessity of living disposed with each pocket, a ring mounted within the hole in each envelope, each ring including a pair of hinged semi-circular sections, and locking means for locking the free ends of the sections together, said envelopes being freely slidable on the ring so that a person can designate the illustration representing his need, release of said locking means and withdrawal of the ring from the hole in an envelope enabling a card to be inserted and removed from the pocket of said envelope.

2. The communication aid of claim 2, and including a flexible strap for connecting the ring to an outside object.

* * * * *